US007310982B2

(12) United States Patent
Ogawa et al.

(10) Patent No.: US 7,310,982 B2
(45) Date of Patent: Dec. 25, 2007

(54) ROLLING METHOD AND ROLLING APPARATUS FOR FLAT-ROLLED METAL MATERIALS

(75) Inventors: Shigeru Ogawa, Futtsu (JP); Atsushi Ishii, Futtsu (JP); Yasuhiro Higashida, Futtsu (JP); Takashi Hisatsune, Kimitsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/550,082

(22) PCT Filed: Mar. 12, 2004

(86) PCT No.: PCT/JP2004/003299

§ 371 (c)(1),
(2), (4) Date: Sep. 19, 2005

(87) PCT Pub. No.: WO2004/082860

PCT Pub. Date: Sep. 30, 2004

(65) Prior Publication Data

US 2006/0230799 A1 Oct. 19, 2006

(30) Foreign Application Priority Data

Mar. 20, 2003 (JP) ..... 2003-077025
Feb. 5, 2004 (JP) ..... 2004-028743

(51) Int. Cl.
*B21B 37/58* (2006.01)

(52) U.S. Cl. ..... 72/10.4; 72/14.4; 72/248; 72/365.2

(58) Field of Classification Search ..... 72/242.2, 72/7.6, 8.1, 8.3, 8.4, 8.7, 8.9, 9.1, 10.4, 11.1, 72/11.7, 14.4, 18.7, 241.6, 241.8, 237, 205, 72/160

See application file for complete search history.

(56) References Cited

U.S. PATENT DOCUMENTS 3,290,912 A * 12/1966 Reid ..... 72/10.4

(Continued)

FOREIGN PATENT DOCUMENTS

JP 60046812 A * 3/1985

(Continued)

OTHER PUBLICATIONS

Patent Abstracts of Japan: JP 59189012 A, Publication Date: Oct. 26, 1984; JP 59110408 A, Publication Date: Jun. 26, 1984; JP 59073109 A, Publication Date: Apr. 25, 1984; JP 2002346615, Publication Date: Dec. 3, 2002.

*Primary Examiner*—Dmitry Suhol
(74) *Attorney, Agent, or Firm*—Kenyon & Kenyon LLP

(57) ABSTRACT

The invention provides a rolling method for a flat-rolled metal material and a rolling apparatus for the method each capable of stably producing a flat-rolled metal material free from camber or having an extremely light camber. The method is a rolling method of a flat-rolled metal material executed by using a rolling mill including at least work rolls and backup rolls. The apparatus is a rolling mill for this method. A rolling direction force acting on roll chocks on the operator side and the driving, side of the work roll is measured, the difference of the rolling direction force between the operator side and the driving side is calculated and a left-right swivelling component of roll gap of the rolling mill is controlled on the basis of this difference.

9 Claims, 7 Drawing Sheets

U.S. PATENT DOCUMENTS

| | | | | | |
|---|---|---|---|---|---|
| 3,587,266 | A | * | 6/1971 | Randich | 72/11.8 |
| 3,733,875 | A | * | 5/1973 | Steimer | 72/237 |
| 3,818,742 | A | * | 6/1974 | Maltby et al. | 72/238 |
| 4,089,196 | A | * | 5/1978 | Kondo et al. | 72/8.6 |
| 4,116,028 | A | * | 9/1978 | Okamoto et al. | 72/10.6 |
| 4,154,080 | A | * | 5/1979 | Suzuki et al. | 72/237 |
| 4,320,643 | A | * | 3/1982 | Yasuda et al. | 72/10.6 |
| 4,570,472 | A | * | 2/1986 | Kuwano | 72/8.4 |
| 5,267,170 | A | * | 11/1993 | Anbe | 700/154 |
| 5,279,139 | A | * | 1/1994 | Sturm | 72/13.4 |
| 6,354,128 | B1 | * | 3/2002 | Donini et al. | 72/237 |
| 6,401,506 | B1 | * | 6/2002 | Ogawa et al. | 72/14.4 |
| 6,619,087 | B2 | * | 9/2003 | Ogawa et al. | 72/14.4 |

FOREIGN PATENT DOCUMENTS

| | | | | |
|---|---|---|---|---|
| JP | 04-305304 | | | 10/1992 |
| JP | 06269818 | A | * | 9/1994 |
| JP | 07-214131 | | | 8/1995 |
| JP | 08-323411 | | | 12/1996 |
| JP | 10230308 | A | | 9/1998 |
| JP | 2001-105013 | | | 4/2001 |
| JP | 2002210513 | A | * | 7/2002 |
| JP | 2002-346615 | | | 12/2002 |
| TW | 397719 | | | 1/1987 |

* cited by examiner

ROLLING METHOD AND ROLLING APPARATUS FOR FLAT-ROLLED METAL MATERIALS

TECHNICAL FIELD

This invention relates to a rolling method and to a rolling apparatus for flat-rolled metal materials. More particularly, the invention relates to a rolling method and to a rolling apparatus, for flat-rolled metal materials that can stably produce flat-rolled metal materials not having, or having extremely light, camber.

BACKGROUND ART

In a rolling process of a flat-rolled metal material, it is very important to roll a sheet material in a form free from camber, or in a form not having bend in the left-right direction, in order to avoid not only a plane shape defect and a dimensional accuracy defect of the rolled material but also to avoid sheet pass troubles such as a zigzag movement and a tail crash.

Incidentally, to simplify expressions, the operator side and the driving side of the rolling mill, as the right and left sides when the rolling mill is seen from the front of the rolling direction, will be called "right and left", respectively.

To cope with such problems, Japanese Unexamined Patent Publication (Kokai) No. 4-305304 discloses a camber control technology that arranges devices for measuring the lateral positions of the rolled material on the entry and exit sides of the rolling mill, calculates the camber of the rolled material from the measured values and regulates the position of an edger roll, arranged on the entry side of the rolling mill, to correct the camber.

On the other hand, Japanese Unexamined Patent Publication (Kokai) No. 7-214131 discloses a camber control technology that controls a left-right difference of roll gap of the rolling mill, that is, reduction leveling, on the basis of a left-right difference in edger roll loads provided on the entry and exit sides of the rolling mill.

Japanese Unexamined Patent Publication (Kokai) No. 2001-105013 discloses a camber control technology that analyzes actual measurement values of a left-right difference of rolling loads and controls a left-right difference of roll gap, that is, reduction leveling, or positions of side guides.

Japanese Unexamined Patent Publication (Kokai) No. 8-323411 discloses a method that conducts camber control by restricting a rolled material by an edger roll and a side guide on the entry side and a side guide on the exit side.

However, the invention relating to the camber control technology by the lateral position measurement of the rolled material described in Japanese Unexamined Patent Publication (Kokai) No. 4-305304 is basically directed to the correction of the camber that has already occurred and cannot substantially, in advance, prevent the occurrence of a camber.

According to the invention relating to the camber control technology based on the edger roll load left-right difference on the entry and exit sides of the rolling mill and described in Japanese Unexamined Patent Publication (Kokai) No. 7-214131, it is difficult to acquire good control accuracy when the camber already exists in the rolled material on the entry side because the camber operates as disturbance to the edger roll load difference on the entry side. The edger roll on the exit side must be saved back at the time of passing of the distal end of the rolled material in order to avoid impingement, and it is difficult, too, to conduct camber control from the distal end of the rolled material.

According to the invention relating to the camber control technology based on the rolling load left-right difference described in Japanese Unexamined Patent Publication (Kokai) No. 2001-105013, the method of estimating the camber from the left-right difference of the rolling load has extremely low accuracy and is not practical when the sheet thickness of the rolled material on the entry side is not uniform in the sheet width direction or when the temperature distribution of the rolled material is not uniform in the sheet width direction.

In the invention relating to the camber control by using the edger roll on the entry side, the side guide on the entry side and the side guide on the exit side and described in Japanese Unexamined Patent Publication (Kokai) No. 8-323411, the exit side camber can be made zero if the side guide on the exit side can completely restrict the rolled material on the exit side. However, because the side guide on the exit side must be kept greater than the sheet width of the rolled material in order to smoothly carry out the rolling operation, the camber occurs on the rolled material to an extent corresponding to this margin.

After all, it can be concluded that the problems of the prior art technologies described above result from the absence of the method that can measure and control very accurately and without a time delay the camber that occurs owing to various causes.

It is therefore an object of the invention to provide a rolling method for a flat-rolled metal material and a rolling apparatus for the method that can advantageously solve the problems of the prior art technologies, regarding the camber control described above, and can stably produce a flat-rolled metal material not having, or having extremely light, camber.

DISCLOSURE OF THE INVENTION

The gist of the invention for solving the problems of the prior art technologies is as follows.

(1) A rolling method for a flat-rolled metal material, for executing rolling by using a rolling mill having at least work rolls and backup rolls for a flat-rolled metal material, comprising the steps of measuring a rolling direction force acting on roll chocks on a operator side and a driving side of the work roll; calculating the difference of the rolling direction force between the operator side and the driving side; and controlling a left-right swivelling component of roll gap of the rolling mill on the basis of the difference.

(2) A rolling method of a flat-rolled metal material as described in (1), further comprising the steps of measuring a camber of a rolled material; and learning a control target value of the difference of the rolling direction force between the operator side and the driving side on the basis of the camber.

(3) A rolling apparatus for a flat-rolled metal material including a rolling mill having at least work rolls and backup rolls, comprising load detection devices for measuring a rolling direction force acting on work roll chocks, arranged on both the entry side and the exit side of the roll chocks, in a rolling direction on both the work side and the driving side of the work rolls.

(4) A rolling apparatus for a flat-rolled metal material as described in (3), further comprising a device for pressing the work roll chock in the rolling direction, arranged on either one of the entry side and the exit side of the work roll chock in the rolling direction.

(5) A rolling apparatus for a flat-rolled metal material as described in (4), wherein the device for pressing the work roll chock in the rolling direction is a hydraulic powered device.

(6) A rolling apparatus for a flat-rolled metal material as described in (4) or (5), further comprising a device for pressing the work roll chock in the rolling direction, arranged on the side opposite to the side in which the work roll is offset with the backup roll being the reference, of the entry side and the exit side of the work roll chock in the rolling direction.

(7) A rolling apparatus for a flat-rolled metal material as described in any of (3) through (6), further comprising a calculation device for calculating a difference of rolling direction force acting on the work roll chock between the operator side and the driving side on the basis of a measurement value by the load detection device; a calculation device for calculating a left-right swivelling component control quantity of roll gap of the rolling mill on the basis of the calculation value of the difference of the rolling direction force between the operator side and the driving side; and a control device for controlling the roll gap of the rolling mill on the basis of the calculation value of the left-right swivelling component control value of the roll gap.

(8) A rolling apparatus as described in any of (3) through (6), further comprising a camber measurement device for measuring camber of a rolled material.

(9) A rolling apparatus for a flat-rolled metal material as described in any of (3) through (9), further comprising a calculation device for calculating a difference of rolling direction force acting on the work roll chock between the operator side and the driving side on the basis of a measurement value by the load detection device; a calculation device for calculating a left-right swivelling component control quantity of roll gap of the rolling mill on the basis of the calculation value; a control device for controlling the roll gap of the rolling mill on the basis of the calculation value of the left-right swivelling component control value of the roll gap; a camber calculation device for measuring camber of the rolled material; and a calculation device for learning a control target value of the difference of the rolling direction force between the operator side and the driving side on the basis of the camber measurement value by the camber measurement device.

BRIEF DESCRIPTION OF THE DRAWINGS

FIG. 10 is a graph showing a change in a relation, between a left-right difference of rolling direction force and a camber quantity, due to wear of the rolls and the like.

BEST MODE FOR CARRYING OUT THE INVENTION

Figure 1:
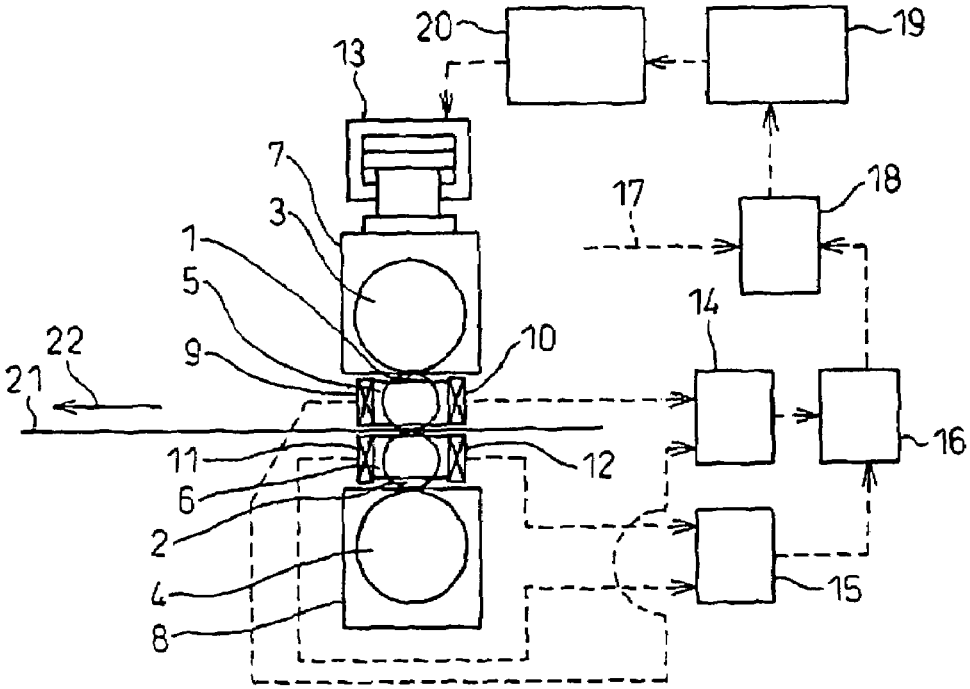
FIG. 1 is a view schematically showing a preferred form of a rolling apparatus relating to a rolling method of a flat-rolled metal material according to: the invention described in (1) or a rolling apparatus, of a flat-rolled metal material of the invention described in (7).

A mode for carrying out the invention will be hereinafter explained.

Generally, the causes of the occurrence of camber in rolling of flat-rolled materials are a setting defect of a roll gap, a left-right difference of the thickness of the rolled material on the entry side and a left-right difference of deformation resistance of the rolled material. Whichever the cause may be, the left-right difference occurs eventually in longitudinal strain in a rolling direction due to rolling. Consequently, a forward slip and a backward slip change in a sheet width direction, and an exit-side speed and an entry-side speed of the rolled material exhibit a left-right difference, to thereby cause the camber. At this time, during rolling, of a distal end portion of the rolled material that is likely to invite the camber, for example, the length of the rolled material on the exit side for which rolling has already been finished is short and the exit-side speed causes the left-right difference under a relatively free state. In order for the entry-side speed to exhibit the left-right difference, the rolling material at the entry side must cause rigid rotation as a whole inside a horizontal plane. However, during rolling of the distal end portion, as a long non-rolled material generally remains on the entry side, a moment against the rigid rotation described above occurs owing to the weight of the rolled material itself and to friction with a table roller. As this moment is transmitted as a reaction to the work roll of the rolling mill, a left-right difference occurs in the rolling direction force acting on the work roll chock portion and the moment is finally supported.

According to the rolling method of the flat-rolled metal material of the invention described in (1), the rolling direction forces acting on roll chocks on the operator side and the driving side of the work roll are measured and the difference between the rolling direction force on the operator side and the rolling direction force on the driving side, that is, the rolling direction force left-right difference, is calculated. Therefore, the moment acting mainly from the entry side rolled material during rolling of the distal end portion can be detected from this value. This moment occurs only when the left-right difference of the longitudinal strain that results in the occurrence of the camber develops as described above. Moreover, this moment occurs substantially simultaneously with the occurrence of the longitudinal strain difference. Therefore, the occurrence of the camber can be prevented in advance by operating the left-right swivelling component of the roll gap of the rolling mill, that is, a reduction leveling, in such a direction that reduces the rolling direction force left-right difference.

The principle described above holds true of rolling of the tail end portion of the rolled material at which the camber is most likely to occur next to rolling of the distal end portion of the rolled material. During rolling of the tail end portion, the length of the rolled material on the exit side, that has already been rolled, is large and the moment occurs mainly from the exit side rolled material in such a fashion as to withstand the longitudinal strain and the left-right difference of the forward slip when they are about to occur and is transmitted as the reaction to the work roll. In this case, too, the occurrence of the left-right difference of the longitudinal stain can be detected by measuring and calculating the left-right difference of the rolling direction forces acting on the work roll chock. Consequently, the occurrence of the camber at the tail end portion can be prevented in advance by operating the left-right swivelling component of the roll gap of the mill, that is, the reduction leveling, in a direction that reduces the rolling direction force left-right difference.

As explained above, the method of the invention described in (1) detects and measures the left-right difference of the longitudinal strain due to rolling that may directly result in the occurrence of the camber, and immediately executes the reduction leveling operation for making the left-right difference uniform. Therefore, the method can provide rolling that is substantially free from the occurrence of the camber or has extremely light camber.

As described in (1), rolling substantially free from the occurrence of the camber becomes possible by the method that measures the rolling direction force acting on the roll chocks on the operator side and the driving side of the work roll, calculates the difference between the rolling direction force on the operator side and the rolling direction force on the driving side, that is, the rolling direction left-right difference and operates the reduction leveling of the rolling mill in the direction that reduces this rolling direction force left-right difference.

In the method described above, however, when the left-right difference of the roll diameter or the left-right difference of the frictional coefficient occurs due to the wears etc, of the rolls, there is the possibility of the shift of the rolling direction force left-right difference. Therefore, even when reduction leveling is operated in the direction that reduces the rolling direction force left-right difference, there remains the possibility that the occurrence of the camber cannot be prevented sufficiently.

Therefore, to eliminate the possible problem described above, the rolling method of the flat-rolled metal material of the invention described in (2) measures the rolling direction force acting on the roll chocks on the operator side and the driving side of the work roll, calculates the difference of the rolling direction force between the operator side and the driving side, sets the control target value of the rolling direction force left-right difference on the basis of this difference, that is, the rolling direction force left-right difference, when the reduction leveling control is executed, and executes the reduction leveling control so as to attain this control target value. This control target value is generally set to zero, and the invention proposes a rolling method that measures the camber of the rolled material after or during rolling and learns the control target value on the basis of this camber actual measured value. When the control target value is learnt in this way on the basis of the camber actual measured value after rolling and sets the learnt control target value to rolling of this pass or the next pass, it becomes possible to correct deviation of the rolling direction force resulting from the wear, etc, of the rolls, to correctly detect and measure the left-right difference of the longitudinal strain with rolling that may directly result in the occurrence of the camber, and to execute the reduction leveling operation for making the left-right difference uniform. In this way, rolling substantially free from the occurrence of the camber or having an extremely light camber can be accomplished.

Next, the invention relating to a rolling apparatus for executing the rolling method of the flat-rolled metal material of the invention described in (1) will be explained.

In the rolling apparatus of the flat-rolled metal material of the invention described in (3), the load detection devices are provided on both entry side and the exit side of the rolling chocks in the rolling direction on the operator side and the driving side of the work roll. Therefore, when the resultant force is calculated by taking directivity of the load measurement values on both entry and exit sides into consideration, the rolling direction force acting on the roll chocks on the operator side and the driving side can be determined. Furthermore, the rolling method of the flat-rolled metal material described in (1) can be executed when the difference of the rolling direction force acting on the roll chock on the operator side and the rolling direction force acting on the roll chock on the driving side is calculated.

The rolling apparatus of the invention described in (4) has a device for pressing the work roll chock in the rolling direction on either the entry side or the exit side of the work roll chock in the rolling direction. When rolling is carried out while the work roll chock is pressed in the rolling direction by such a device construction, the moment can be immediately detected as the rolling direction force left-right difference acting on the work roll chock when the moment acts from the rolled material on the work roll due to the left-right difference of the longitudinal stain as described above. Consequently, a camber control system having more excellent in response and accuracy can be achieved.

In the rolling apparatus of the flat-rolled metal material of the invention described in (5), the device for pressing the work roll chock in the rolling direction is a hydraulic powered device. Because the hydraulic powered device presses the work roll chock, the press force can be controlled to a low level that does not hinder the rolling operation. Moreover, vibration of the work roll chock in the rolling direction can be reduced and good control can be done to such an extent that it can stabilize the chock position.

The rolling apparatus of the flat-rolled metal material of the invention described in (6) includes a device for pressing the work roll chock in the rolling direction, arranged on the side opposite to the side in which the work roll is offset with the backup roll being the reference, of the entry side and the exit side of the work roll chock in the rolling direction. According to this arrangement, the offset component of force that occurs as a horizontal direction component of force of the rolling load due to the work roll offset operates in the same direction as the press force created by the device described above. Consequently, the press force to be given so as to stabilize the rolling direction position of the work roll chock becomes small and the size of the pressing device can be reduced. When the rolling direction press force to the work roll chock becomes excessively great, the problem occurs in the follow-up performance to the reduction position control during rolling given by a sheet thickness control function but the occurrence of such a problem can be avoided by reducing the press force by this rolling direction press device.

The rolling apparatus for a flat-rolled metal material of the invention further includes a calculation device for calculating a difference of rolling direction force acting on the work roll chock between the operator side and the driving side in addition to the rolling apparatus of the flat-rolled metal material described in any of (3) through (6). Therefore, the rolling apparatus can detect the moment resulting from the left-right difference of the longitudinal strain in the rolling direction and acting from the rolled material onto the work roll that may result in the camber. Furthermore, the rolling apparatus includes a calculation device for calculating a left-right swivelling component control quantity of roll gap of the rolling mill on the basis of the calculated value of the difference of the rolling direction force between the operator side and the driving side, for making the longitudinal strain uniform in the left-right direction and a control device for controlling the roll gap of the rolling mill on the basis of the calculated value of the left-right swivelling component control value of the roll gap. Therefore, the rolling mill can prevent in advance the occurrence of the left-right difference of the longitudinal strain and can roll a flat-rolled metal material free from camber or having extremely light camber.

Next, the invention of the rolling apparatus for executing the rolling method of the flat-rolled metal material of the invention described in (2) will be explained.

The rolling apparatus of the flat-rolled metal material of the invention described in (8) includes load detection devices on both the exit side and the entry side of the roll chocks in the rolling direction on the operator side and the driving side of the work rolls in the same way as the rolling apparatus of the invention described in (3). Therefore, when the resultant force is calculated by taking directivity of the load measurement values on both entry and exit sides, the rolling direction force acting on the roll chock on each of the operator and driving sides can be determined even when the force acts in any of the entry and exit sides and the difference between the rolling direction force acting on the operator side roll chock and the rolling direction force acting on the driving side roll chock can be calculated. Furthermore, because the rolling apparatus includes a camber measurement device, the control target value can be learnt on the basis of the camber actual record of the rolled material after the rolling and the rolling method of the flat-rolled metal material described in (2) can be executed. Incidentally, the rolling apparatus described in (8) can be equipped with the device for pressing the roll chock in the rolling direction in the same way as the rolling apparatuses described in (4) to (6).

The rolling apparatus of the flat-rolled metal material of the invention described in (9) includes a calculation device for calculating the difference of the rolling direction force acting on the work roll chock between the operator side and the driving side in addition to the rolling apparatus described in (8). Therefore, the rolling apparatus can detect the moment that results from the left-right difference of the longitudinal strain in the rolling direction that may result in the camber, and acts from the rolled material on the work roll. Because the rolling apparatus further includes a calculation device for learning a control target value of the difference of the rolling direction force between the operator side and the driving side on the basis of the camber measurement value of the rolled material, the shift quantity can be corrected by learning on the basis of the camber actual measurement value even when the difference of the rolling direction force acting on the work roll chock shifts due to the wear, etc, of the rolls and the suitable control target value can be calculated. Further, the rolling apparatus includes a calculation device for calculating a left-right swivelling component control quantity of roll gap of the rolling mill for making the longitudinal strain uniform in the left-right direction on the basis of the calculation value, and a control device for controlling the, roll gap of the rolling mill on the basis of the calculated value of the left-right swivelling component control value of the roll gap. Therefore, the rolling apparatus can prevent in advance the occurrence of the left-right difference of the longitudinal strain and can roll a flat-rolled metal material free from the camber or having an extremely light camber. Incidentally, the rolling apparatus described in (9) may be provided with the press device for pressing the roll chock in the rolling direction in the same way as the rolling apparatuses described in (4) to (6).

Next, the embodiment of the invention will be explained further concretely with reference to the drawings.

FIG. 1 shows the rolling apparatus relating to the rolling method described in (1) or the rolling apparatus described in (7) according to a preferred embodiment of the invention.

A rolling mill includes an upper work roll 1 supported by an upper work roll chock 5, an upper backup roll 3 supported by an upper backup roll chock 5, for backing up the upper work roll 1, a lower work roll 2 supported by a lower work roll chock 6 and a lower backup roll 4 supported by a lower backup roll chock 7, for backing up the lower work roll 2. The rolling mill further includes a screw down device 13. Incidentally, a flat-rolled metal material 21 is rolled in a rolling direction 22.

Though FIG. 1 basically shows only the apparatus construction on the operator side, similar devices exist on the driving side, too.

The rolling direction force acting on the upper work roll 1 of the rolling mill is basically supported by the upper work roll chock 5. The upper work roll chock 5 is provided with an upper work roll chock exit side load detection device 9 and an upper work roll entry side load detection device 10. These load detection devices 9 and 10 can measure the force acting between the members such as a project block (not shown) fixing the upper work roll chock 5 in the rolling direction and the upper work roll chock 5. To simplify the device construction, these load detection devices 9 and 10 preferably and ordinarily have a construction for measuring a compressive force. An upper work roll rolling direction force calculation device 14 calculates a difference of measurement results by the upper work roll exit side load detection device 9 and the upper work roll entry side load detection device 10 and also calculates the rolling direction force acting on the upper work roll chock 5. As for the rolling direction force acting on the lower work roll 2, a lower work roll rolling direction force calculation device 15 calculates the rolling direction force acting on the work roll chock 6 on the basis of the measurement values of a lower work roll exit side load detector 11 and a lower work roll entry side load detector 12 that are arranged on the exit side and the entry side of the lower work roll chock 6.

Next, a work roll rolling direction resultant force calculation device 16 calculates the sum of the calculation result of the upper work roll rolling direction force calculation device 14 and the calculation result of the lower work roll rolling direction force calculation device 15 to calculate the rolling direction resultant force acting on the upper and lower work rolls. This procedure is conducted not only for the operator side but also for the driving side by using entirely the same construction and the result is obtained as the work roll rolling direction resultant force 17 on the driving side. A operator side/driving side rolling direction force difference calculation device 18 calculates the difference between the calculation results on the operator side and on the driving side and in this way, the difference of the rolling direction force acting on the work roll chock between the operator side and the driving side is calculated.

Next, a reduction leveling control quantity calculation device 19 sets the difference of the rolling direction force acting on the work roll chock between the operator side and the driving side to a suitable target value and calculates a left-right swivelling component control quantity on the basis of the calculation result of the difference of the rolling direction force between the operator side and the driving side for preventing the camber. Here, the control quantity is calculated by PID calculation that takes a proportional (P) gain, an integration (I) gain and a differential (D) gain into consideration, for example. A reduction leveling control device 20 controls the left-right swivelling component of the roll gap of the rolling mill on the basis of this control quantity calculation result and rolling free from the occurrence of camber or having extremely slight camber can be accomplished.

In the device construction described above, only addition and subtraction are basically done on the outputs of eight load detection devices on both operator side and driving side before the calculation result of the operator side/driving sides rolling direction force difference calculation device 18 is obtained. Therefore, the device construction and the sequence of calculation described above may be arbitrarily changed. For example, it is possible to first add the outputs of the upper and lower exit side load detection devices, then to calculate the difference from the addition result on the entry side and to finally calculate the difference between the operator side and the driving side. Alternatively, it is possible to first calculate the difference of the outputs of the load detection devices at the respective positions on the operator side and the driving side, then to calculate the sum of the upper and lower detection devices and to finally calculate the difference between the entry side and the exit side.

Figure 2:
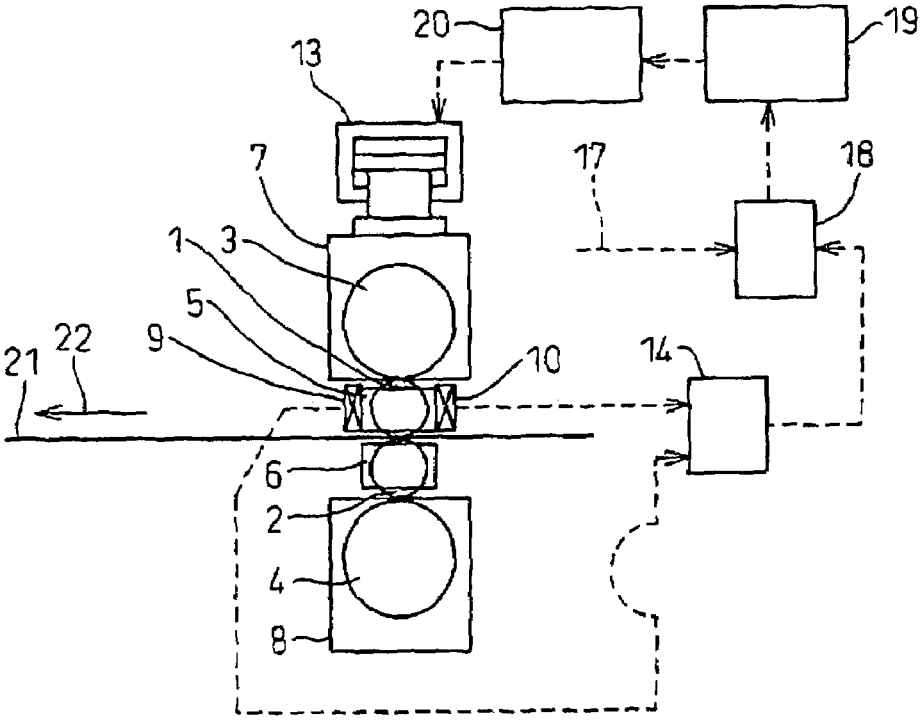
FIG. 2 is a view schematically showing another preferred form of the rolling apparatus relating to the rolling method of a flat-rolled metal material according to the invention described in (1) or the rolling apparatus of the flat-rolled metal material of the invention described in (7).

FIG. 2 shows another preferred form of the rolling apparatus relating to the rolling method of the invention described in (1) or the rolling apparatus of the invention described in (7). In the embodiment shown in FIG. 2, the detection device and the calculation device for the rolling direction force acting on the lower work roll chock are omitted in comparison with the embodiment shown in FIG. 1. Generally, the moment resulting from the left-right difference of the longitudinal strain and acting from the rolled material on the work rolls does not always act uniformly on the upper and lower work rolls but the tendency of its time series change behavior does not reverse for the upper and lower work rolls. Therefore, when the suitable control gain is set in the reduction leveling control quantity calculation device 19, excellent camber control can be accomplished on the basis of the left-right difference of the rolling direction force acting on either one of the upper and lower work rolls.

In the embodiments shown in FIGS. 1 and 2, the left-right swivelling component of the roll gap is the direct control parameter but in the case of extremely light reduction rolling such as skin pass rolling, the rolling operation is executed in many cases with the rolling load as the target value. In such a case, the left-right difference of the rolling load may be calculated as the control target value. In other words; the control quantity of the left-right difference of the rolling load is calculated in such a direction that eliminates the left-right difference of the rolling direction force acting on the work roll chock on the basis of this left-right difference of the rolling direction force and when the loading load control is made with this control quantity as the target value, the left-right swivelling component of the roll gap can be eventually controlled.

Figure 3:
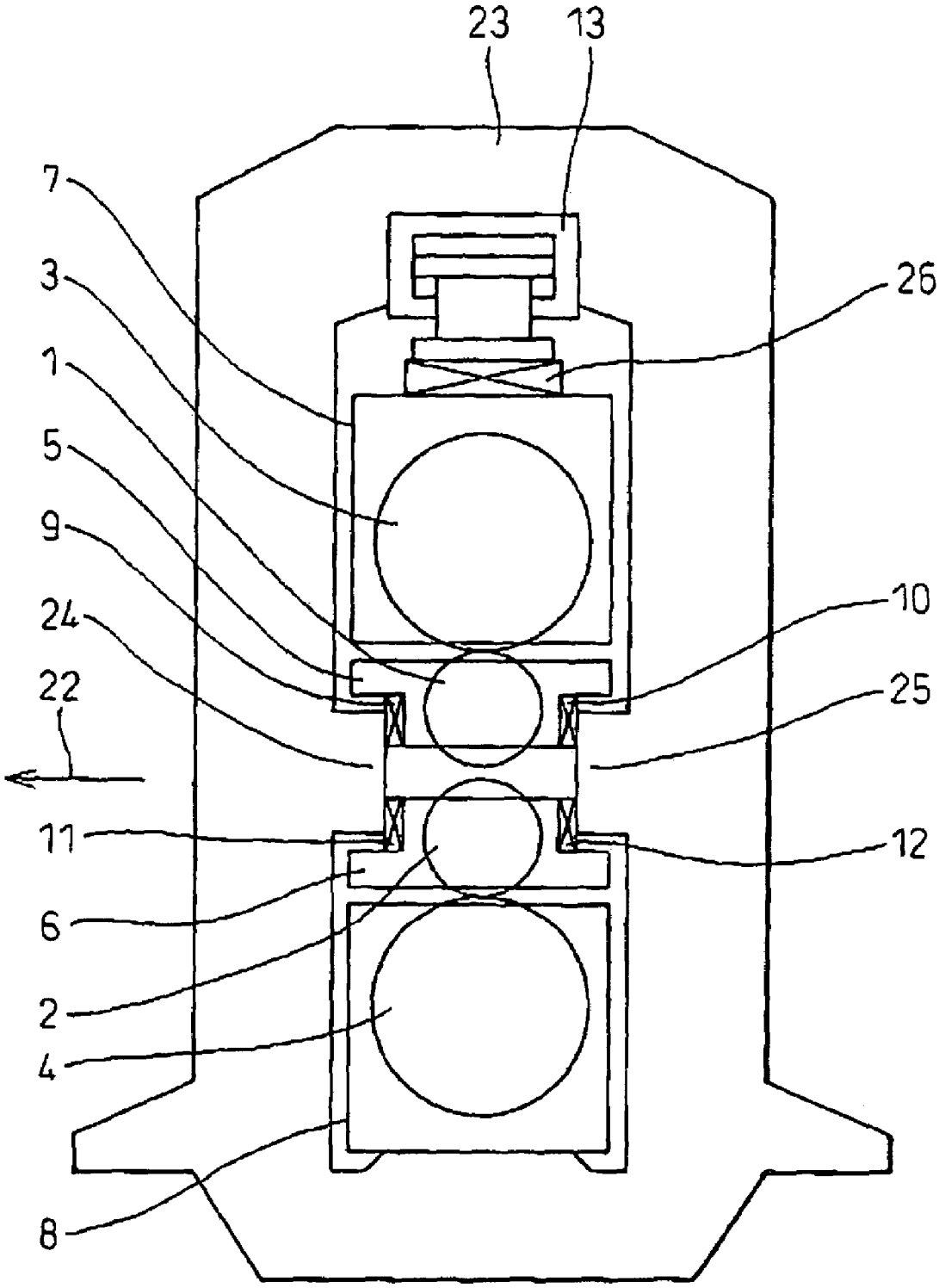
FIG. 3 is a view schematically showing a preferred form of a rolling apparatus of a flat-rolled metal material according to the invention described in (3).

FIG. 3 shows a preferred form of the rolling apparatus of the invention described in (3). In the rolling apparatus shown in FIG. 3, a roll balance device (not shown in the drawing) built in project blocks 24 and 25 fixed to a housing 23 support the work roll chock in a vertical direction. Incidentally, the rolling apparatus includes a rolling load detection device 26 between the reduction device 13 and the upper backup roll. To measure the rolling direction force acting on the upper work roll chock 5, the upper work roll exit side load detection device 9 is interposed between the exit side project block 24 and the upper work roll chock 5 and the upper work roll entry side load detection device 10 is interposed between the entry side project block 24 and the upper work roll chock 5. To measure the rolling direction force acting on the lower work roll chock the lower work roll exit side load detection device 11 is interposed between the exit side project block 24 and the lower work roll chock 6 and the lower work roll entry side load detection device 12 is interposed between the entry side project block 25 and the lower work roll chock 6. Because the load detection devices are arranged in this way on both entry and exit sides, the magnitude of the force can be correctly measured even when the rolling direction force acts in any direction on the work roll chocks.

Figure 4:
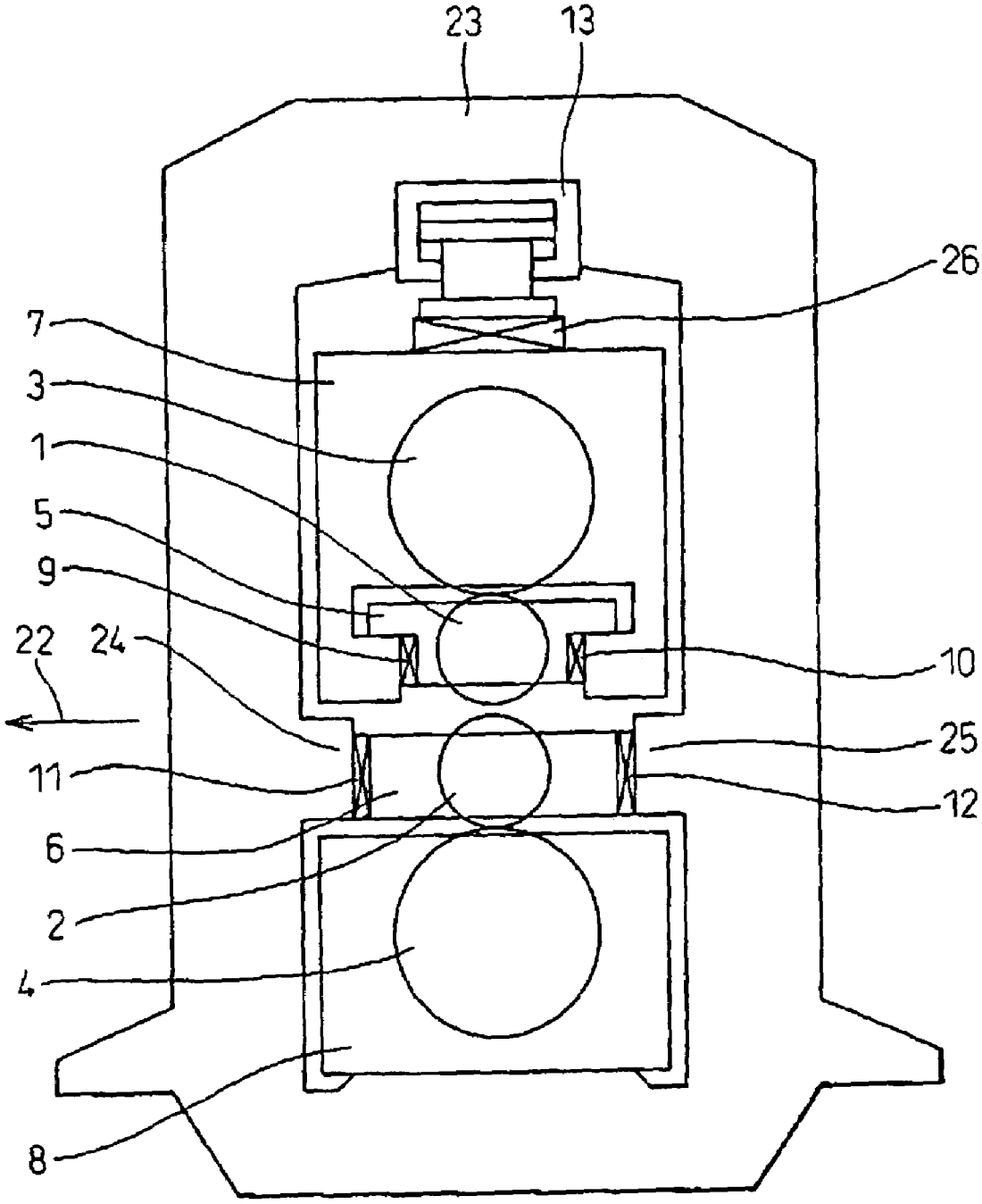
FIG. 4 is a view schematically showing another preferred form of the rolling apparatus of the flat-rolled metal material according to the invention described in (3).

FIG. 4 shows another preferred form of the rolling apparatus of the invention described in (3). In the rolling apparatus shown in FIG. 4, the upper backup roll chock 7 is of the type that embraces the upper work roll chock 5. In this case, to measure the rolling direction force acting on the upper work roll chock 5, the upper work roll exit side load detection device 9 and the upper work roll entry side load detection device 10 are interposed between the upper work roll chock 5 and the upper backup roll chock 7. In this case, too, the magnitude of the force can be correctly measured even. when the rolling direction force acts in any direction on the work roll chocks because the load detection devices are arranged on both entry and exit sides of the work roll chock.

Figure 5:
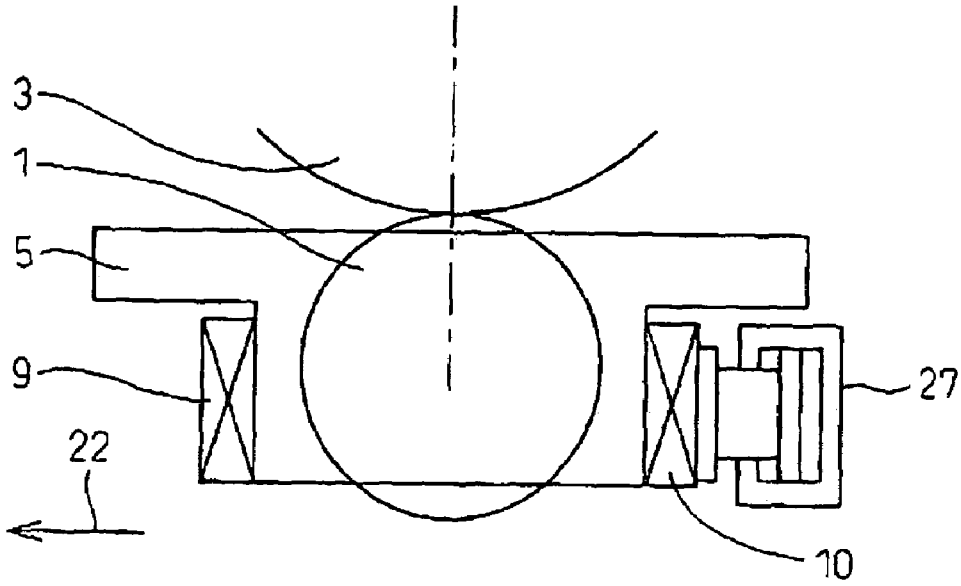
FIG. 5 is a view schematically showing a preferred form of a rolling apparatus of a flat-rolled metal material according to the invention described in (4) or (5).

FIG. 5 shows a preferred form of the rolling apparatus of the metal sheet material of the invention described in (4) or (5). In the rolling apparatus of the flat-rolled metal material shown in FIG. 5, an entry side work roll chock press device 27 is arranged adjacent to the upper work roll entry side load detection device 10 on the entry side of the upper work roll chock 5 and this press device 27 presses the work roll chock 5 from the entry side to the exit side with predetermined press force. This construction can stabilize the rolling direction position of the upper work roll chock 5 and can improve response and accuracy of the measurement of the rolling direction force acting on the upper work roll chock 5. Incidentally, in the rolling apparatus shown in FIG. 5, the entry side work roll chock press device 27 is a hydraulic powered device. When such a construction is employed, even when the work roll chock momentarily vibrates in the rolling direction such as when the rolled material is caught, a stable press force operates and the movement of the work roll chock can be stabilized.

Figure 6:
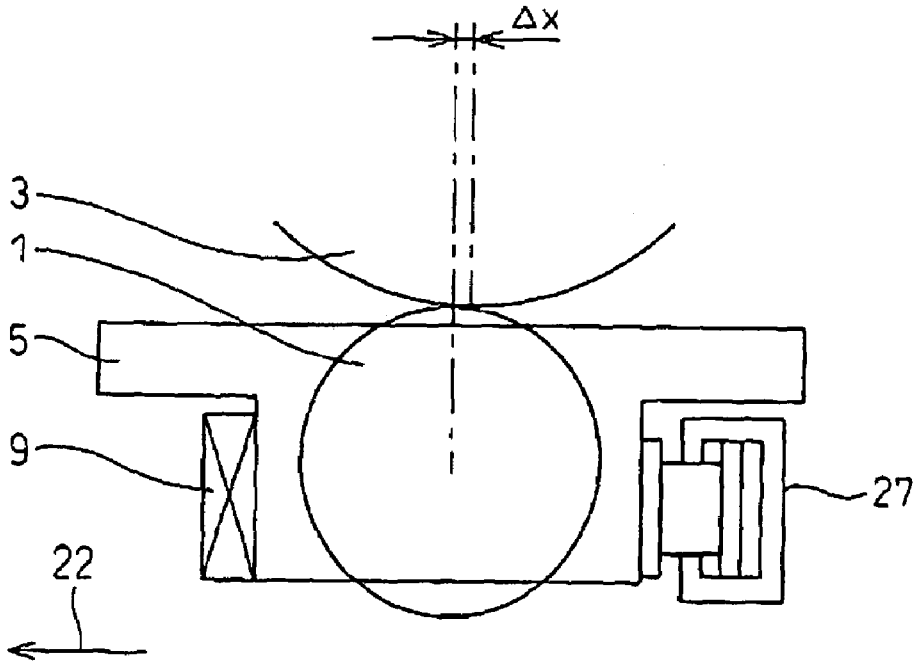
FIG. 6 is a view schematically showing a preferred form of a rolling apparatus of a flat-rolled metal material according to the invention described in (6).

FIG. 6 shows a preferred form of the rolling apparatus of the flat-rolled metal material of the invention described in (6). In the rolling apparatus of the flat-rolled metal material shown in FIG. 6, the upper work roll is offset by $\Delta x$ on the entry side and the entry side work roll chock press device 27 is arranged on the entry side of the upper work roll chock 5. According to this construction, the offset force acting from the upper backup roll 3 on the upper work roll 1 operates in such a direction as to press the upper work roll chock 5 in the exit side direction and the force of the entry side work roll chock press device 27 can be decreased, so that the setup can be rendered compact in scale and economical. At the same time, because the clamping force of the upper work roll chock 5 can be decreased, disturbance factors, for other controls, can be reduced, too. Incidentally, the upper work roll entry side load detection device 10 is omitted in the rolling apparatus of the flat-rolled metal material shown in FIG. 6 but this is the example where the hydraulic powered device itself is used as a substitute for the load detection device by arranging a sensor (not shown) for measuring an operation oil supplied to the hydraulic cylinder of the entry side work roll chock press device 27 as the hydraulic powered device in FIG. 6.

Figure 7:
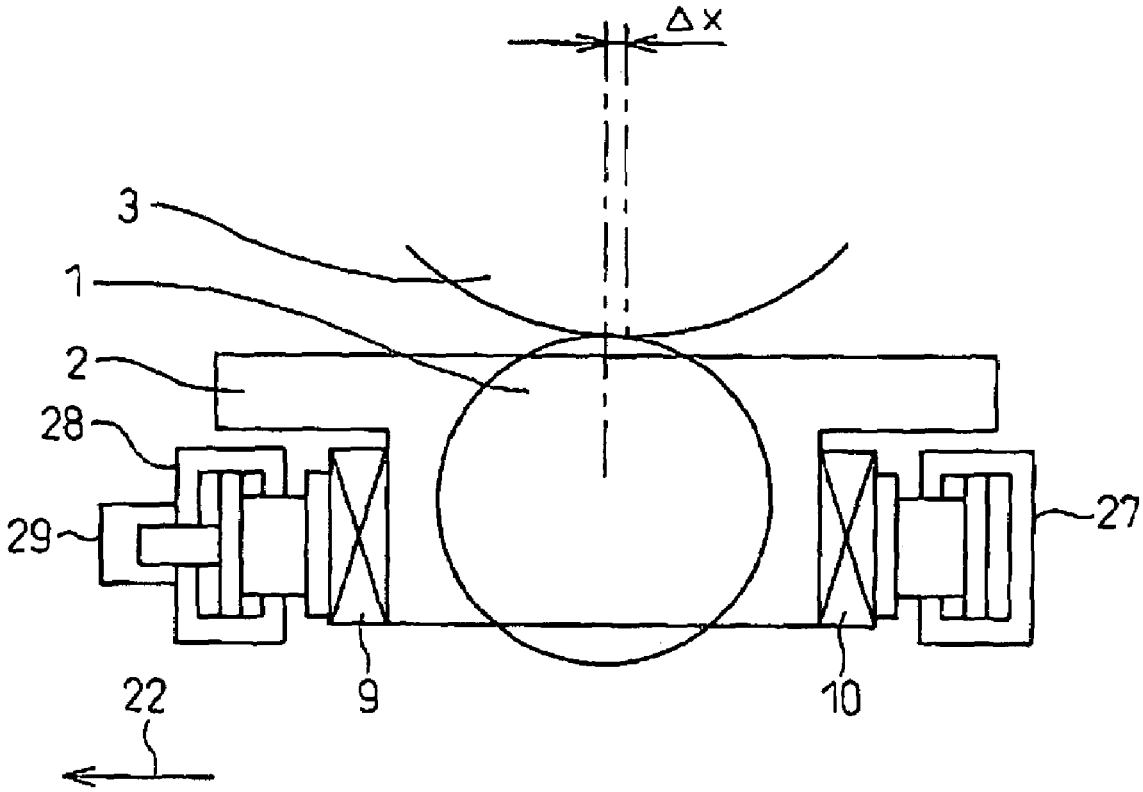
FIG. 7 is a view schematically showing another preferred form of the rolling apparatus of a flat-rolled metal material according to the invention described in (6).

FIG. 7 shows another preferred form of the rolling apparatus of the flat-rolled metal material of is the invention described in (6). In the rolling apparatus of the flat-rolled metal material shown in FIG. 7, an exit side work roll chock position control device 28 is arranged on the exit side of the upper work roll chock in addition to the form shown in FIG. 6. This exit side work roll chock position control device 28 is also a hydraulic powered device. In the rolling apparatus shown in FIG. 6, the upper work roll chock 5 is structurally interposed between the entry and exit side hydraulic cylinders but in the case of the exit side work roll chock position control device 28, an exit side work roll chock position detection device 29 is disposed to execute position control, and the clamping force of the chock is given by the entry side work roll chock press device. According to such a construction, an additional control capacity such as adjustment of the offset quantity of the work roll or a minute cross angle between the backup rolls can be acquired.

Incidentally, the embodiments shown in FIGS. 5, 6 and 7 represent the examples where the work roll chock press device is arranged on the entry side of the rolling mill but it may also be arranged on the exit side. However, the relative positional relation with the work roll offset must be maintained.

The embodiments shown in FIGS. 5, 6 and 7 represent the embodiments only in the proximity of the upper work roll chock, but the embodiment when applied to the lower work roll chock is basically the same.

Figure 8:
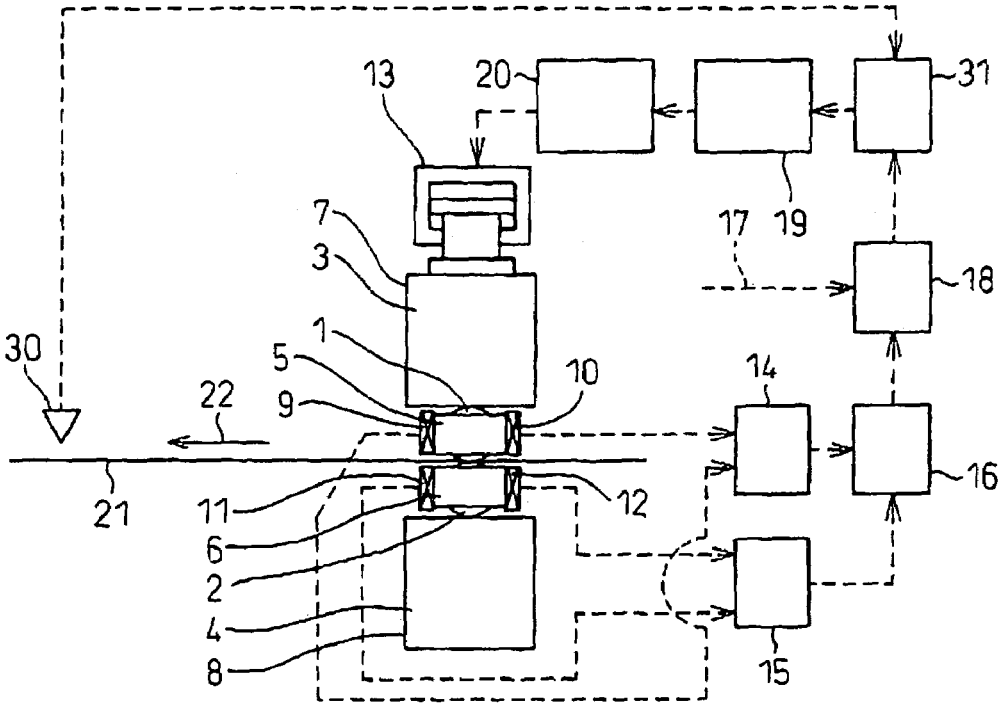
FIG. 8 is a view schematically showing a preferred form of a rolling apparatus relating to a rolling method of a flat-rolled metal material according to the invention described in (2) or a rolling apparatus of a flat-rolled metal material of the invention described in (9).

Next, FIG. 8 shows another preferred form of the rolling apparatus of the flat-rolled metal material relating to the rolling method of the invention described in (2) or the rolling apparatus described in (9). Incidentally, FIG. 8 basically shows only the apparatus construction on the operator side but a similar apparatus exits on the driving side, too. The rolling direction force acting on the upper work roll 1 is basically supported by the upper work roll chock 5. The upper work roll chock is provided with the upper work roll chock exit side load detection device 9 and the upper work roll entry side load detection device 10 and can measure the force acting between members such as a project block (not shown) and the upper work roll chock. To simplify the apparatus construction, these load detection devices preferably and generally have a construction for measuring the compressive force. The upper work roll rolling direction force calculation device 14 calculates the difference of the measurement results between the upper work roll exit side load detection device 9 and the upper work roll entry side load detection device 10 and also calculates the rolling direction force acting on the upper work roll chock 5. As for the rolling direction force acting on the lower work roll 2, too, the lower work roll rolling direction force calculation device 15 calculates the rolling direction force acting on the lower work roll chock 6 on the basis of the measurement results of the lower work roll exit side load detection device 11 and the lower work roll entry side load detection device 12 that are provided on the exit side and entry side of the lower work roll chock 6, respectively. Next, the lower work roll rolling direction resultant force calculation device 16 calculates the sum of the calculation result of the upper work roll rolling direction force calculation device 14 and the calculation result of the lower work roll rolling direction force calculation device 15 to calculate the rolling direction resultant force acting on the upper and lower work rolls. The procedure described above is executed not only on the operator side but also on the driving side by using entirely the same apparatus construction and the result is obtained as the work roll rolling direction resultant force 17 on the driving side. The operator side/driving side rolling direction force difference calculation device 18 calculates the difference between the calculation result on the operator side and the calculation result on the driving side, so that the difference of the rolling direction force acting on the work roll chock on the operator side and the driving side, that is, the rolling direction force left-right difference, is calculated.

Figure 10:
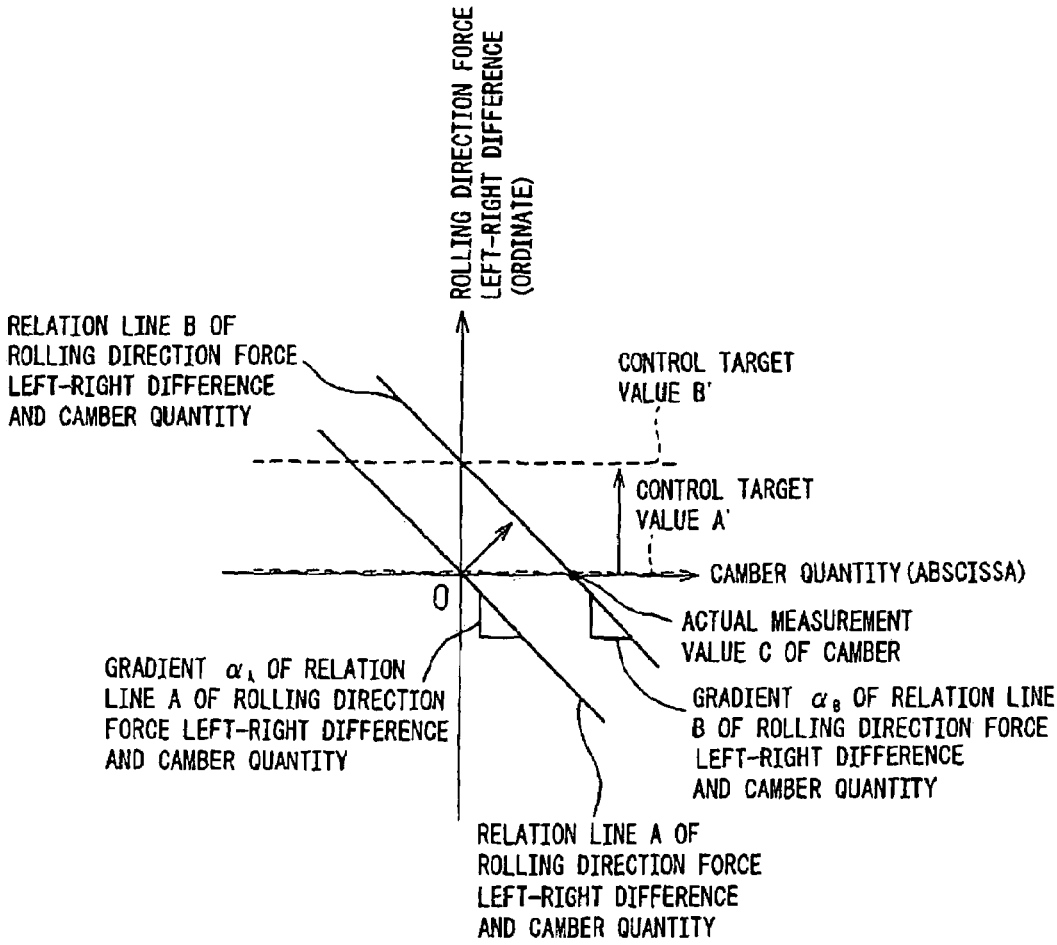

Next, the control target value calculation device 31 calculates the control target value of the rolling direction force left-right difference and this calculation method will be explained. Generally, the control target value of the rolling direction left-right difference is zero and the occurrence of the camber can be prevented by controlling the left-right swivelling component of the roll gap of the rolling mill so that the rolling direction force left-right difference reaches this control target value. However, when the left-right difference of the roll diameter occurs due to wear of the roll, etc, or when the left-right difference of the frictional coefficient occurs, the rolling direction force left-right difference is likely to shift due to these factors and in this case, the control target value is not set to zero but must be changed to a suitable value. FIG. 1 is a graph showing the change of the relation between the rolling direction force left-right difference due to wear, etc, of the roll and the camber quantity. As shown in FIG. 10, the relation line A, between the rolling direction force left-right difference and the camber quantity, shifts substantially parallel as indicated by the relation line B due to the wear, etc, of the roll. In this case, to make the camber quantity zero, a control target value A' must be changed to a control target value B'. The shift of the relation line between the rolling direction force left-right difference and the camber quantity and the change of the control target value can be easily judged by measuring the camber quantity during, or after, rolling. In other words, it will be assumed that when control is executed to acquire the control target value A' as shown in FIG. 10, the camber actual measurement value is not zero but the camber actual measurement value is C. Then, it is possible to judge that the relation between the rolling direction force left-right difference and the camber quantity shifts as represented by the line B. Therefore, the control target value may well be changed to a target value Be in this pass or in the next pass or in rolling of the next material. Because this deviation of the rolling direction force left-right difference resulting from the wear of the roll possibly changes with the increase of the number of passes of rolling, the control target value must always be learnt and changed, too. Incidentally, symbols $\alpha_A$ and $\alpha_b$ in the graph represent the gradients of the relation lines A and B between the rolling direction force left-right difference and the camber quantity, respectively. They are constants that are determined by the size of the rolling mill, the rolling condition, deformation resistance of the rolled material, and so forth. When these gradients change due to the wear of the roll, etc, the gradients must be determined in advance by conducting preparatory experiments. However, $\alpha_A$ and $\alpha_B$ may be regarded as substantially equal and may be set to $\alpha_A=\alpha_B$ (=α) by primary approximation when the conditions are satisfied, though these values change depending on the rolling condition and the rolling material. However, as these values may change with time, the value $\alpha_B$ may be periodically measured.

Therefore, the invention conducts learning of the control target value of the rolling direction force left-right difference by the following method. As shown in FIG. 8, a camber measurement device 30 is provided to the back of the rolling mill and can measure the camber of the rolled material during or after rolling. The value of the camber quantity so measured is sent to the control target value calculation device 31. The control target value calculation device 31 calculates the control target value in this pass or the next pass or during rolling of the next material by the method described above on the basis of this measurement value of the camber quantity. This control target value must be learnt and changed with the increase of the number of passes of rolling and must be learnt for each pass or for a predetermined number of rolling passes in accordance with the following formula <1>:

$$C^{(n)}=C_r^{(n-1)}\times\gamma+C^{(n-1)}\times(1-y) \quad <1>$$

Here, $C^{(n)}$ represents the control target value of the nth pass or nth rolled material, $C_r^{(n)}$ is the control target value corrected on the basis of the camber actual value of the nth pass or the nth rolled material and γ is the learning gain (0 to 1.0).

The rolling reduction leveling control quantity calculation device 19 calculates the left-right swivelling component control quantity of the roll gap of the rolling mill for preventing the camber on the basis of the calculation result of the difference between the control target value and the rolling direction force on the operator side and the driving side. Incidentally, in the stage in which the camber quantity of the first rolling is not actually measured, the control target value may be the value of the rolling direction force left-right difference occurring at the time of fastening of a kiss roll or zero, for example. Here, the left-right swivelling component control quantity of the roll gap is calculated by PID calculation taking the proportional (P) gain, the integration (I) gain and the differential (D) gain into consideration, for example, for the control target value determined from the left-right difference of the rolling direction force and from the formula (1). The reduction leveling control device 20 controls the left-right swivelling component of the roll gap of the rolling mill on the basis of this control quantity calculation result and rolling free from the occurrence of the camber or having extremely light camber can be accomplished. Incidentally, to change the control target value in this pass, the control target value may be changed during rolling at the stage in which the camber quantity is actually measured.

Figure 9:
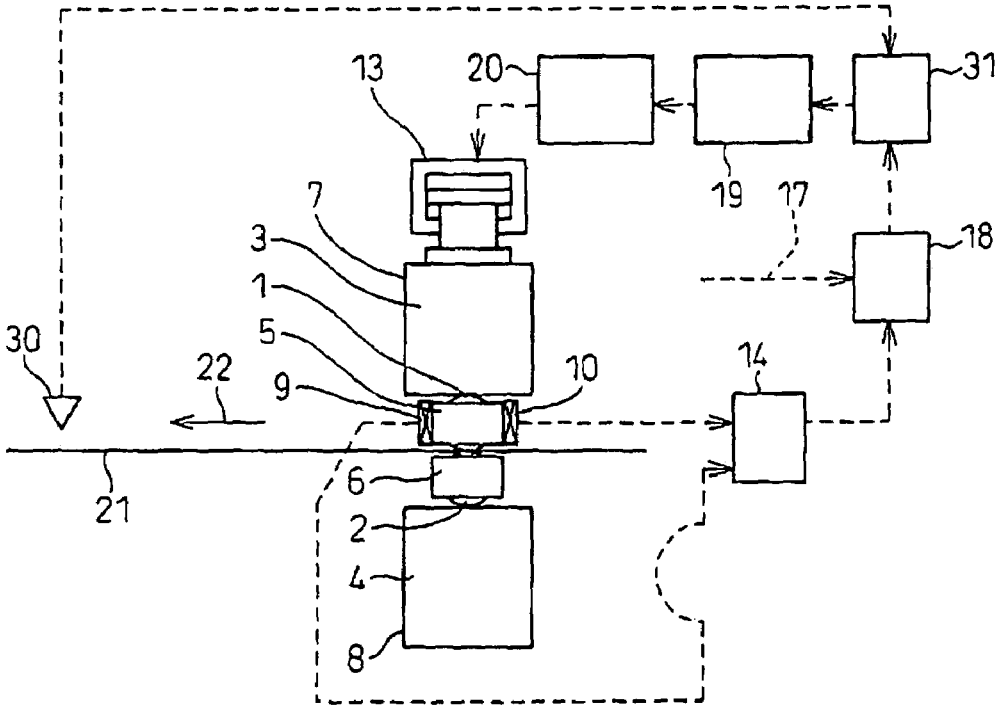
FIG. 9 is a view schematically showing a preferred form of a rolling apparatus relating to a rolling method of a flat-rolled metal material according to the invention described in (2) or a rolling apparatus of a flat-rolled metal material of the invention described in (9).

FIG. 9 shows another preferred form of the rolling apparatus relating to the rolling method of the invention described in (2) or the rolling apparatus of the invention described in (9). In the embodiment shown in FIG. 9, the detection devices and the calculation devices of the rolling direction force acting on the lower work roll chock are omitted in comparison with the embodiment shown in FIG. 8. Generally, the moment resulting from the left-right difference of the longitudinal strain and acting from the rolled material on the work rolls does not always act uniformly on the upper and lower work rolls. Though the tendency of its time series change behavior does not reverse for the upper and lower work rolls, the zero point of the rolling direction force left-right difference may shift. In this case, too, the camber of the rolled material is measured during or after rolling and the control target value learnt from this camber actual measurement value is set to this pass or to the next pass or rolling of the next material. As the deviation of the rolling direction force left-right difference can be corrected in this way, excellent camber control can be accomplished on the basis of the left-right difference of the rolling direction force acting on either one of the upper and lower work rolls.

Incidentally, in the embodiments shown in FIGS. 8 and 9, too, the work roll chock press device may be arranged on the entry side of the rolling mill in the same way as in the embodiments shown in FIGS. 5, 6 and 7 or may be arranged on the exit side, on the contrary. However, the relative positional relation with the work roll offset shown in FIGS. 6 and 7 must be maintained.

The embodiments shown in FIGS. 5, 6 and 7 may be likewise applied to the lower work roll chock, too.

EXAMPLE

An example where the sheet rolling method of the invention described in (2) is executed by using the rolling mill shown in FIG. 8 will be explained. Learning of the control target value of the rolling direction force left-right difference that is based on the output of the camber measurement device 30 provided to the back of the rolling mill is executed while the learning gain is set to γ 0.3 and the control target value in the initial stage is set to zero. Incidentally, a constant within the range of 0.5 to 20 tonf/(mm/m) is set for each rolling condition and each rolling material as a constant α representing the gradient of the relation line between the rolling direction force left-right difference and the camber quantity.

Table 1 tabulates the control target values of the rolling direction left-right difference with respect to the typical number of rolling passes and the actual measurement value of the camber. As can be understood from Table 1, the camber actual measurement value per meter is limited to a small value of 0.15 mm/m or below in each of the typical numbers of rolling passes. It can be understood, too, that the control target value of the rolling direction force left-right difference changes depending on learning based on the camber actual measurement values as the number of rolling passes increases. The change of the control target value presumably results from the wear of the backup rolls and the work rolls, etc. Because those methods which do not conduct learning of the control target value as is done in the sheet rolling method of the invention execute control inclusive of these error factors, the camber may presumably become greater in comparison with the method of the invention.

TABLE 1

| | final rolling pass of first rolled material | final rolling pass of 300th rolled material | final rolling pass of 500th rolled material |
|---|---|---|---|
| control target value of rolling direction left-right difference (tonf, operator side-driving side) | 0 | 22 | 44 |
| camber actual measurement value (mm/m) | 0.15 | 0.1 | 0.14 |

As described above, the sheet rolling method of the invention learns the control target value on the basis of the camber actual measurement value after rolling, sets this learnt control target value to rolling of the next pass, corrects deviation of the rolling direction force left-right difference and can correctly detect and measure the left-right difference of the longitudinal strain due to rolling that is the direct cause of the occurrence of the camber. It has been confirmed that when the rolling reduction leveling operation for rendering the left-right difference uniform is executed, rolling with extremely light camber can be steadily made irrespective of the number of rolling passes.

INDUSTRIAL APPLICABILITY

It becomes possible to steadily and stably produce flat-rolled metal materials free from camber or having an extremely light camber without depending on the number of rolling passes when the rolling method of the flat-rolled metal material and the rolling apparatus according to the invention are used, and drastic improvements can be achieved in the rolling process of the flat-rolled metal material and in the production yield.

The invention claim is:

1. A rolling method of a flat-rolled metal material, for executing rolling by using a rolling mill having at least flat-rolled metal material horizontal work rolls and backup rolls, comprising the steps of:

measuring rolling direction force acting on roll chocks on an operator side and a driving side of said work rolls;

calculating the difference of said rolling direction force between the operator side and the driving side; and controlling a left-right difference of roll gap of said rolling mill on the basis of said calculated difference.

2. A rolling method of a flat-rolled metal material according claim 1, further comprising the steps of:

measuring camber of a rolled material; and learning a control target value of the difference of said rolling direction force between the operator side and the driving side on the basis of said camber.

3. A rolling apparatus for a flat-rolled metal material including a rolling mill having at least flat-rolled metal material horizontal work rolls and backup rolls, comprising:

load detection devices for measuring rolling direction force acting on work roll chocks, arranged on both entry side and exit side of said roll chocks in a rolling direction on both operator side and driving side of said work rolls, and a calculation device for calculating rolling direction force acting on said work roll chocks on a basis of a difference of the measured value between the entry side and the exit side of said load detection devices.

4. A rolling apparatus for a flat-rolled metal material according to claim 3, further comprising:

a device for pressing said work roll chock in the rolling direction, arranged on either one of the entry side and the exit side of said work roll chock in the rolling direction.

5. A rolling apparatus for a flat-rolled metal material according to claim 4, wherein said device for pressing said work roll chock in the rolling direction is a hydraulic powered device.

6. A rolling apparatus for a flat-rolled metal material according to claim 4 or 5, further comprising:

a device for pressing said work roll chock in the rolling direction, wherein said work roll is offset with respect to said backup roll, said device for pressing arranged on the side opposite to the side in which said work roll is offset, of the entry side and the exit side of said work roll chock in the rolling direction.

7. A rolling apparatus for a flat-rolled metal material according to claim 3, 4 or 5 further comprising:

a calculation device for calculating a difference of rolling direction force acting on said work roll chock between the operator side and the driving side on the basis of a measurement value by said load detection device;

a calculation device for calculating a left-right difference control quantity of roll gap of said rolling mill on the basis of the calculation value of the difference of said rolling direction force between the operator side and the driving side; and a control device for controlling the roll gap of said rolling mill on the basis of the calculation value of the left-right difference control value of the roll gap.

8. A rolling apparatus for a flat-rolled metal material according to claim 3, 4 or 5 further comprising:

a camber measurement device for measuring camber of a rolled material.

9. A rolling apparatus for a flat-rolled metal material according to claim 3, 4 or 5 further comprising:

a calculation device for calculating a difference of rolling direction force acting on said work roll chock between the operator side and the driving side on the basis of a measurement value by said load detection device;

a calculation device for calculating a left-right difference control quantity of roll gap of said rolling mill on the basis of the calculation value;

a control device for controlling the roll gap of said rolling mill on the basis of the calculation value of the left-right difference control value of the roll gap;

a camber measurement device for measuring camber of the rolled material; and a calculation device for learning a control target value of the difference of said rolling direction force between the operator side and the driving side on the basis of the camber measurement value by said camber measurement device.

* * * * *